US005865159A

United States Patent [19]

Henrikson

[11] Patent Number: 5,865,159

[45] Date of Patent: Feb. 2, 1999

[54] ROCKER ARM FOR FUEL INJECTOR OPERATION

[75] Inventor: Magnus Henrikson, Södertälje, Sweden

[73] Assignee: Scania CV AB, Sweden

[21] Appl. No.: 947,453

[22] Filed: Oct. 6, 1997

[30] Foreign Application Priority Data

Oct. 7, 1996 [SE] Sweden ..... 9603641

[51] Int. Cl.[6] ..... F02M 37/04; F01L 1/18

[52] U.S. Cl. ..... 123/508; 123/90.39

[58] Field of Search ..... 123/508, 90.39, 123/509; 239/585.5, 584

[56] References Cited

U.S. PATENT DOCUMENTS

| | | | |
|---|---|---|---|
| 4,448,166 | 5/1984 | Amemori et al. | 123/90.39 |
| 4,471,909 | 9/1984 | Perr | 239/89 |
| 5,553,592 | 9/1996 | Bauerle et al. | 123/508 |
| 5,588,413 | 12/1996 | Stone et al. | 123/508 |
| 5,647,325 | 7/1997 | Axbrink | 123/496 |
| 5,713,335 | 2/1998 | Perr et al. | 123/508 |

*Primary Examiner*—Thomas N. Moulis

*Attorney, Agent, or Firm*—Ostrolenk, Faber, Gerb & Soffen, LLP

[57] ABSTRACT

A rocker arm for fuel injector operation in a combustion engine wherein the rocker arm transmits driving power from an overhead camshaft to a fuel injector of unit type. The rocker arm has at least one non-metallic spring element which is incorporated as a resilient link in the power transmission between the camshaft and the fuel injector. The spring element prevents too great forces being transmitted to the fuel injector and the pump piston of the injector. The spring element may take the form of a cylindrical bushing about the rocker arm bearing at the engine to be between the rocker arm and its shaft on the engine and/or about a cam follower shaft on the rocker arm and between the cam follower shaft and a cam follower supported on that shaft.

22 Claims, 1 Drawing Sheet

ROCKER ARM FOR FUEL INJECTOR OPERATION

BACKGROUND OF THE INVENTION

The present invention relates to a rocker arm for operating a fuel injector wherein the rocker arm is driven by a cam to operate the injector, and more particularly relates to the drive between the camshaft and the fuel injector.

The operation of fuel injectors in the form of a unit injector requires the application of a certain force derived from a camshaft. One type of such unit injectors, commonly known as HPI injectors, incorporates a mechanically driven pump piston which, like a mechanical pump of the displacement type, forces fuel out via an injection nozzle. This type of fuel injector incorporates a nozzle which is normally open during the period when the injector is being replenished, unlike other types of unit injectors which have a nozzle which is closed during fuel replenishment. Injectors with closed nozzles therefore incorporate a separate valve on the nozzle which valve, during injection, opens under the influence of a high fuel pressure caused by the fuel having been pumped up in a separate pump section of the injector to sufficiently high pressure to open the valve. In the case of injectors with open nozzles, i.e. HPI injectors, the pressure increase and the injection are brought about by the same pump piston. In this type of injector it is important for the pump piston of the injector to be correctly set relative to the camshaft so that the pump piston is not subject to too great a force which would press it too powerfully against its seat, with consequent risk of deformation, damage and the like. Possible causes of the pump piston "bottoming" in this manner for reasons other than incorrect setting of the fuel injector and/or its drive train include the occurrence of large temperature differences between the injector and the fuel and/or certain parts having become severely worn.

Where the fuel injector drive is taken from an underslung camshaft, as in U.S. Pat. No. 4,471,909, the power-transmitting push rods are inherently flexible enough to be able to absorb elastically the overloads which may occur, without the forces involved being transmitted to the injector and its pump piston. In contrast, where an overhead camshaft is used, where the rocker arm may more directly engage the camshaft without an intermediate push rod, the whole drive train is so rigid that there are no corresponding elements capable of absorbing overloads.

Swedish patent specification SE 501 026 and corresponding U.S. Pat. No. 5,647,325 refers to a fuel injection arrangement provided with a rocker arm comprised of a rigid section and a resilient section which is fixed to the rigid section and which deflects at a predetermined load in order to limit the pressure increase resulting from increasing injection volume. It thus refers to an arrangement provided with a metallic resilient section mounted on the rocker arm between the camshaft and the injector, resulting in the rocker arm being totally rigid up to a limit value and beyond which it becomes elastic. That known arrangement solves the problem by increasing the length of the injection period from a given period without increasing the maximum injection pressure and by creating the possibility of reaching the desired pressure even at partial load and low engine speed, which is a different problem compared with the present invention. That known arrangement relates to the type of fuel injector which has "closed nozzle" according to the foregoing description, which means that that arrangement does not risk being subject to overloads in the manner stated above.

SUMMARY OF THE INVENTION

The object of the present invention is to provide a rocker arm for use on a fuel injector of the above mentioned kind with open nozzle and with the drive train, particularly in the rocker arm, being provided with devices for preventing the pump piston from "bottoming", i.e. from being pressed too powerfully against the injector seat with consequent risk of possible deformation, damage and the like.

The object is also to provide an arrangement which reduces the rigidity of the drive train and which also exhibits a certain degree of elasticity whatever the position of the camshaft.

A further object is therefore to make it possible to use an overhead camshaft for driving a fuel injector of the above mentioned type which does not risk sustaining damage due to its pump piston "bottoming".

According to the invention, the above mentioned objects are achieved with a rocker arm that is swingably supported on a rocker arm shaft and with a resilient link between the camshaft and the rocker arm shaft for serving as a resilient link in the power transmission between the camshaft and the fuel injector. The rocker arm has a cam follower for the camshaft at one end region and is connected to the injector at the other end region. That resilient link is preferably a spring element, preferably non-metallic, e.g. an elastomer, and is so connected with the rocker arm and with at least one of the rocker arm shaft and the cam follower shaft as to absorb slight deflection of the rocker arm in a radial direction with respect to either the rocker arm shaft or the cam follower shaft.

Providing a rocker arm with a non-metallic spring element introduces an elastic element into the drive train between the rocker arm and the camshaft to make it possible to absorb elastically any overloading, thereby eliminating risk of damage to the fuel injector. The non-metallic spring element may be incorporated in the bearing of the rocker arm, or in that of the cam follower, or in both.

Various advantageous embodiments of the invention include the resilient link comprising a bushing of cylindrical shape. The result is an advantageous type of assembly which requires no more fitting space than a conventional rocker arm. Further characteristics and advantages distinguishing the invention are indicated by the examples described below with reference to the attached drawings.

DESCRIPTION OF THE PREFERRED EMBODIMENTS

The invention relates to a device in fuel injection arrangements for combustion engines, particularly for directly injected diesel engines intended for heavy duty vehicles. The fuel injection device, hereinafter called the fuel injector, is of the unit type (unit injector) and is more closely defined by the type known as HPI (High Pressure Injection), which incorporates an open nozzle. The fuel injector is driven by a camshaft, in this case an overhead camshaft 16, via a rocker arm 1 incorporated in a drive train. The term drive train means the movement transmitting devices which are arranged between the camshaft and the fuel injector in order to drive the fuel injector.

A camshaft driven rocker arm for operating a fuel injector is disclosed in U.S. Pat. No. 4,471,909. This patent is incorporated by reference for its teachings about elements which drive and are driven by the rocker arm and its teachings about a fuel injector. But it does not disclose cooperation with an overhead camshaft.

Figure 1:
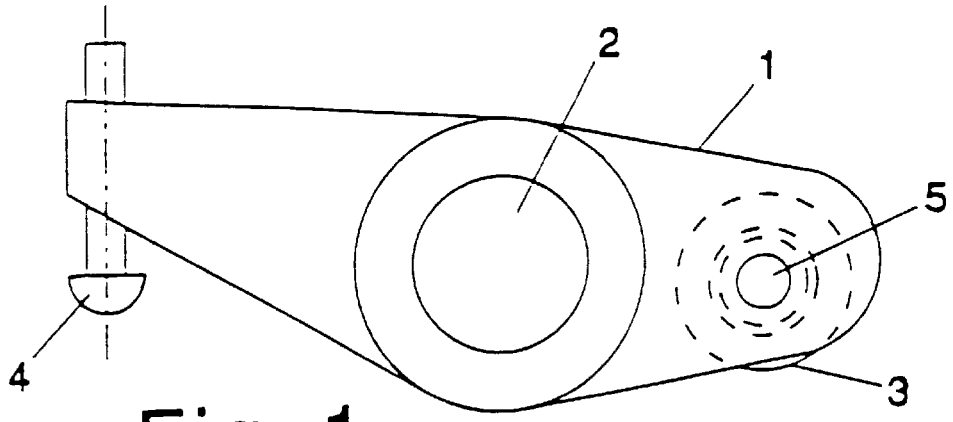
FIG. 1 shows a fist embodiment of a rocker arm of the invention.
Figure 3:
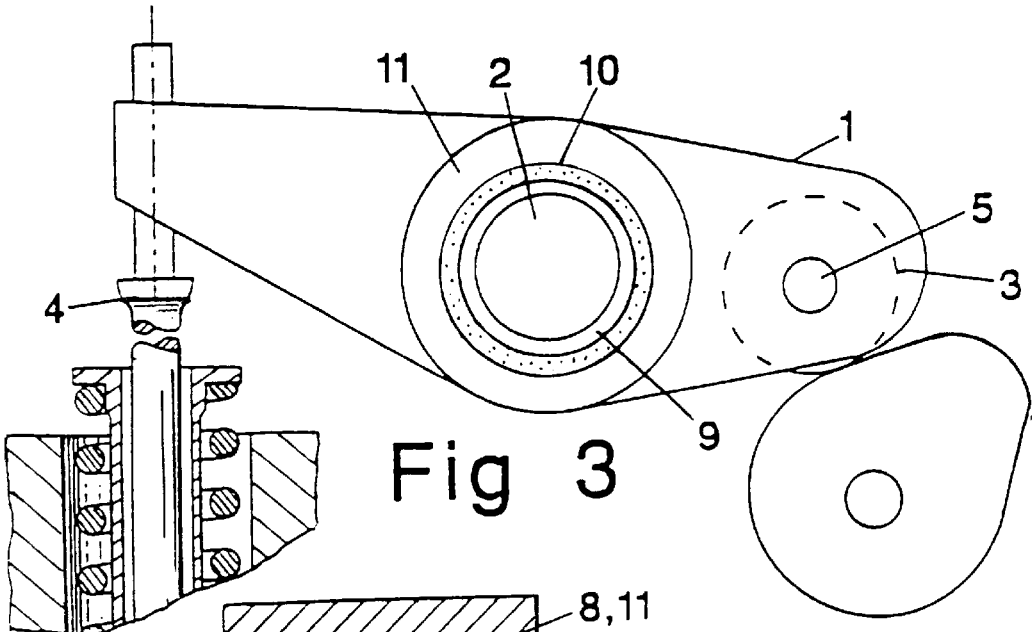
FIG. 3 shows a second embodiment of a rocker arm of the invention with an overhead camshaft and with a part of the fuel injector at the rocker arm.

FIGS. 1 and 3 depict two embodiments of rocker arms 1 wherein the rocker arm 1 is mounted for rotation about a rocker arm shaft 2 which is incorporated in the rocker arm bearing in the engine and about which the rocker arm performs its rocking movement. Although the environment of the rocker arm is shown only in FIG. 3, the rocker arm 1 of both embodiments is provided, at one of its ends and on one side of the rocker arm shaft 2 with a cam follower 3, which abuts movably against the changing profile of the periphery 14 of the camshaft 16, which rotates around the axis 18. The cam follower 3 is mounted in the rocker arm 1 for rotation about a cam follower shaft 5 which is parallel with the rocker arm shaft 2. On the other side of the rocker arm shaft 2, the other end of the rocker arm 1 is provided with an adjusting screw 4 which abuts against an axial piston rod 22 incorporated in the fuel injector 20, e.g. of the type in U.S. Pat. No. 4,471,909. This abutment takes place under the action of a spring 24 arranged in the fuel injector 20. The adjusting screw 4 is conventionally adjustable to make axial adjustment possible between the rocker arm 1 and the fuel injector piston rod 22.

Figure 2:
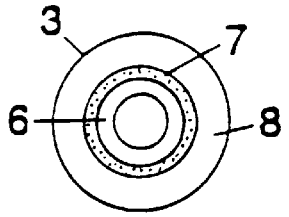
FIG. 2 shows a detail of the embodiment in FIG. 1.

FIGS. 1 and 2 show a first embodiment of the invention. In this case the cam follower 3 is provided with a metallic cylindrical central sleeve 6 about which is arranged a cylindrical bushing 7 made of non-metallic material, such as an elastomer. Around the outside of the bushing 7 is arranged a substantially cylindrical metallic outer sleeve 8 intended to abut against a cam on the camshaft. The outer sleeve 8 is also provided with annular shoulders which limit expansion of the bushing 7 in the axial direction.

The cylindrical central sleeve 6 is mounted like a hub about the cam follower shaft 5 on the rocker arm, whereas the bushing 7 is firmly vulcanized both to the central sleeve 6 and to the outer sleeve 8. In this embodiment, the bushing 7 constitutes an elastic element incorporated in the drive train between the cam follower 3 and the rocker arm shaft on the rocker arm 1.

FIG. 3 shows a second embodiment of the invention wherein the cam follower 3 is of conventional design, i.e. it is directly supported on the rocker arm 1 and particularly on its cam follower shaft 5 on the rocker arm. In this embodiment, the rocker arm shaft 2 is instead provided with a corresponding deflection absorbing bushing.

There is a metallic cylindrical central sleeve 9 that is wrapped around and rocks with the shaft 2 and rocks together with the rocker arm 1. A cylindrical bushing 10 of non-metallic material such as an elastomer is arranged around the sleeve 9. About the outside of the bushing 10 is arranged a substantially cylindrical metallic outer sleeve 11 attached on the rocker arm. Here again the outer sleeve 11 is provided with annular shoulders which limit expansion of the bushing 10 in the axial direction. The cylindrical central sleeve 9 is supported like a hub about the rocker arm shaft 2 to swing with the shaft, whereas the bushing 10 is firmly vulcanized both to the central sleeve 9 and to the outer sleeve 11. The outer sleeve may in practice take the form of a separate sleeve firmly arranged in the rocker arm 1 or may alternatively form an integral part of the rocker arm 1. In this embodiment, the bushing 10 constitutes an elastic element which provides the rocker arm 1 with an elastic fastening to the engine and which makes it possible for the whole rocker arm 1 to deflect radially of the shaft 2 in response to too large a load in the transmission of driving power between the camshaft and the fuel injector.

Figure 4:
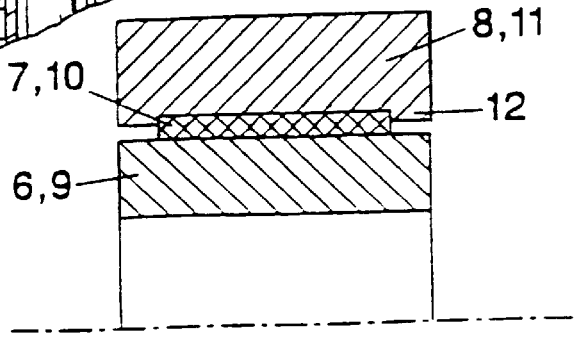
FIG. 4 shows a detail of both embodiments of the invention in axial cross section.

FIG. 4 shows an advantageous embodiment of how the fitting of the non-metallic spring element 7,10 is arranged in the embodiments described above. The spring element 7,10 is introduced into the respective outer sleeve 8, 11, which is provided with annular shoulders 12 on at least one side. The shoulders 12 thus form a kind of guide ring with radial extent. FIG. 4 shows a guide ring axially on both sides of the spring element 7,10. Where there is only one guide ring, the spring element may first be fitted to the outside of the respective central sleeve 6,9. In other cases, the spring element is fitted first in the recess in the outer sleeves between the guide rings 12.

A third embodiment which is also conceivable is a combination of the two embodiments described above. In this case, both the bearing of the rocker arm shaft 2 and that of the cam follower shaft 5 are each provided with a ring of non-metallic material such as an elastomer in the form of a cylindrical bushing as described above.

The characteristics of the bushing made of non-metallic material (i.e. of elastomer, rubber, plastic or the like) and incorporated in these embodiments are such that after deformation caused by a force, the material reverts entirely elastically to its original shape when the force is removed.

In all the embodiments, the spring element 7,10 forms a resilient link in the power transmission between the camshaft and the fuel injector, with the result that in the event of "bottoming" of the fuel injector pump piston, the whole rocker arm or the cam follower 3 fastened in the rocker arm can to a certain extent deflect, it being particularly the case that the respective bushing 7,10 is radially resilient. The expected deflection at either bushing is radial with respect to the shaft, not torsional. As this deflection takes place directly adjacent to the fuel injector, a relatively small elastic range is sufficient. In this case, the radial extent of the respective bushing is dimensioned for a corresponding relatively small resilient movement.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A rocker arm for driving a fuel injector in a combustion engine, wherein the combustion engine includes a camshaft for driving the rocker arm and a fuel injector for being driven by the rocker arm;

the rocker arm having opposite end regions; a rocker arm shaft which receives the rocker arm between the end regions and on which the arm rotatably rocks;

a cam follower toward a first one of the end regions of the rocker arm for riding on the camshaft; the other end region of the rocker arm being engageable with the fuel injector;

a resilient link supported at the rocker arm between the camshaft and the rocker arm shaft for serving as a resilient link in the power transmission between the camshaft and the fuel injector.

2. The rocker arm of claim 1, wherein the resilient link comprises a spring element.

3. The bearing of claim 2, wherein the spring element comprises a non-metallic spring.

4. The rocker arm of claim 3, wherein the non-metallic spring is comprised of an elastomer.

5. The rocker arm of claim 1, wherein the resilient link comprises a non-metallic spring bushing of cylindrical shape having an inside and an outside, one of the inside and the outside of the bushing is connected to be pressed upon by the rocking arm and the other of the inside and the outside is connected to be pressed upon by another element in the power transmission between the camshaft and the fuel injector.

6. The rocker arm of claim 1, wherein the resilient link is between the rocker arm and the rocker arm shaft.

7. The rocker arm of claim 1, wherein the resilient link is disposed between the rocker arm and the rocker shaft.

8. The rocker arm of claim 7, wherein the resilient link comprises a cylindrical spring bushing having an inside around the rocker arm shaft and having an outside connected with the rocker arm.

9. The rocker arm of claim 8, further comprising a metallic sleeve supported on the rocker arm shaft, and the spring bushing is around the rocker arm shaft.

10. The rocker arm of claim 9, wherein the bushing comprises a non-metallic spring.

11. The rocker arm of claim 9, further comprising an annular guide ring on the rocker arm for axially guiding the spring bushing.

12. The rocker arm of claim 11, wherein the annular guide ring comprises an outer sleeve on the outside of and surrounding the spring bushing.

13. The rocker arm of claim 12, wherein the annular guide ring is so shaped with respect to the spring bushing as to define an axial direction guide for retaining the spring bushing and the rocker arm together.

14. The rocker arm of claim 13, wherein the annular guide ring is an integral part of the rocker arm.

15. The rocker arm of claim 1, the resilient link is between the cam follower and the rocker arm.

16. The rocker arm of claim 15, further comprising a cam follower shaft for supporting the cam follower on the rocker arm; the resilient link being between the cam follower shaft and the cam follower.

17. The rocker arm of claim 16, wherein the cam follower comprises a rotatable element for engaging the camshaft for being rotated as the camshaft rotates with reference to the rocker arm and the cam follower shaft supports the cam follower rotatably on the rocker arm, such that the cam follower is rotatable with respect to the cam follower shaft.

18. The rocker arm of claim 16, wherein the resilient link comprises a cylindrical spring bushing having an inside around the cam follower shaft and having an outside connected with the cam follower.

19. The rocker arm of claim 18, further comprising a metallic sleeve supported on the cam follower shaft, the inside of the spring bushing being around the sleeve.

20. The rocker arm of claim 19, wherein the bushing comprises a non-metallic spring.

21. The rocker arm of claim 20, further comprising an annular guide ring on the cam follower for axially guiding the spring bushing.

22. The rocker arm of claim 21, wherein the annular guide ring is so shaped with respect to the spring bushing as to define an axial direction guide for retaining the spring bushing and the cam follower together.

* * * * *